US006860625B2

(12) United States Patent
Bronchak

(10) Patent No.: US 6,860,625 B2
(45) Date of Patent: Mar. 1, 2005

(54) REFLECTIVE FISHING LIGHT AND HEATER BRACKET

(76) Inventor: Steven M. Bronchak, 1880 51st Ter. SW., Naples, FL (US) 34116

( * ) Notice: Subject to any disclaimer, the term of this patent is extended or adjusted under 35 U.S.C. 154(b) by 0 days.

(21) Appl. No.: 10/162,103

(22) Filed: Jun. 3, 2002

(65) Prior Publication Data

US 2003/0223241 A1 Dec. 4, 2003

(51) Int. Cl.[7] ..... B60Q 1/02
(52) U.S. Cl. ..... 362/477; 362/159; 362/396
(58) Field of Search ..... 362/477, 388, 362/396, 159, 548, 430, 209, 282, 399, 523, 549, 345, 299, 346; 248/229.1, 229.15, 311.2, 310, 231.85

(56) References Cited

U.S. PATENT DOCUMENTS

| | | | | |
|---|---|---|---|---|
| 1,174,700 A | | 3/1916 | Eastman | |
| 2,262,203 A | * | 11/1941 | Redstone | 359/504 |
| 2,872,146 A | * | 2/1959 | Kukla | 248/229.15 |
| 2,875,974 A | | 3/1959 | Albert | |
| 2,960,601 A | | 11/1960 | Higgins | |
| 3,008,679 A | | 11/1961 | Powell | |
| 3,745,329 A | | 7/1973 | Runey, Jr. | |
| 3,752,108 A | | 8/1973 | Bovenzi | |
| 3,843,082 A | | 10/1974 | Garrett | |
| 3,847,286 A | | 11/1974 | Garrett | |
| 4,351,626 A | * | 9/1982 | Holmes | 411/311 |
| 4,661,030 A | * | 4/1987 | Delmastro | 411/85 |
| 5,580,151 A | * | 12/1996 | Chen | 362/549 |
| 5,722,119 A | * | 3/1998 | Wang | 16/441 |

* cited by examiner

*Primary Examiner*—Thomas M. Sember
*Assistant Examiner*—Hargobind S. Sawhney

(57) ABSTRACT

A reflective fishing-light-and-heater bracket has a base plate (1) that is designedly rectangular and made to rest on a gunwale of a boat for supporting a gas light (4) and a reflector (5). The base plate includes a gunwale attachment on an attachment end, a light attachment on an attachment end and the reflector on top of the attachment end. The gunwale attachment is adaptable for attachment to all foreseeable gunwales, docks and piers. The base plate includes leg-rod apertures (13) that receive leg rods (14) for being positioned on surfaces (15) or that receive lines for being hung from a hanger. The light attachment includes a cannister basket (12) and a light holder. The reflector includes back-light apertures (38) for selective back lighting. The base plate can be positioned for facing the reflector outwardly or inwardly at variable angles from a boat, pier, a marine structure (21) or water-side surface (15).

28 Claims, 11 Drawing Sheets

FIG. 5
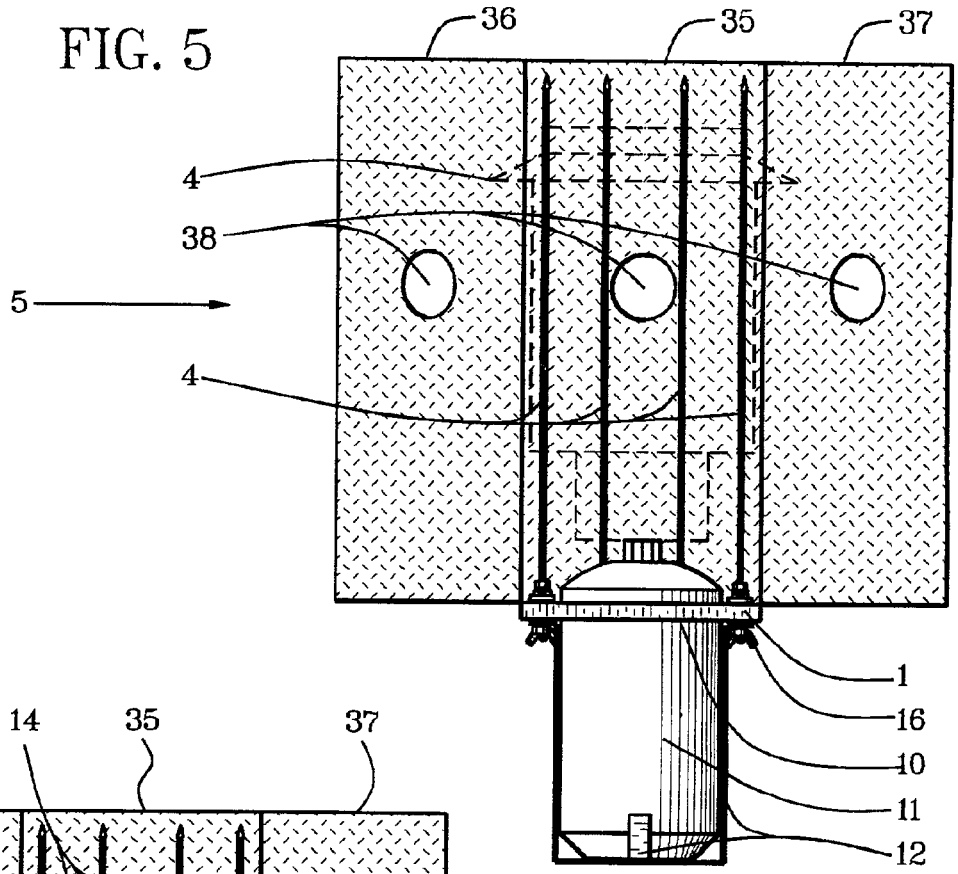
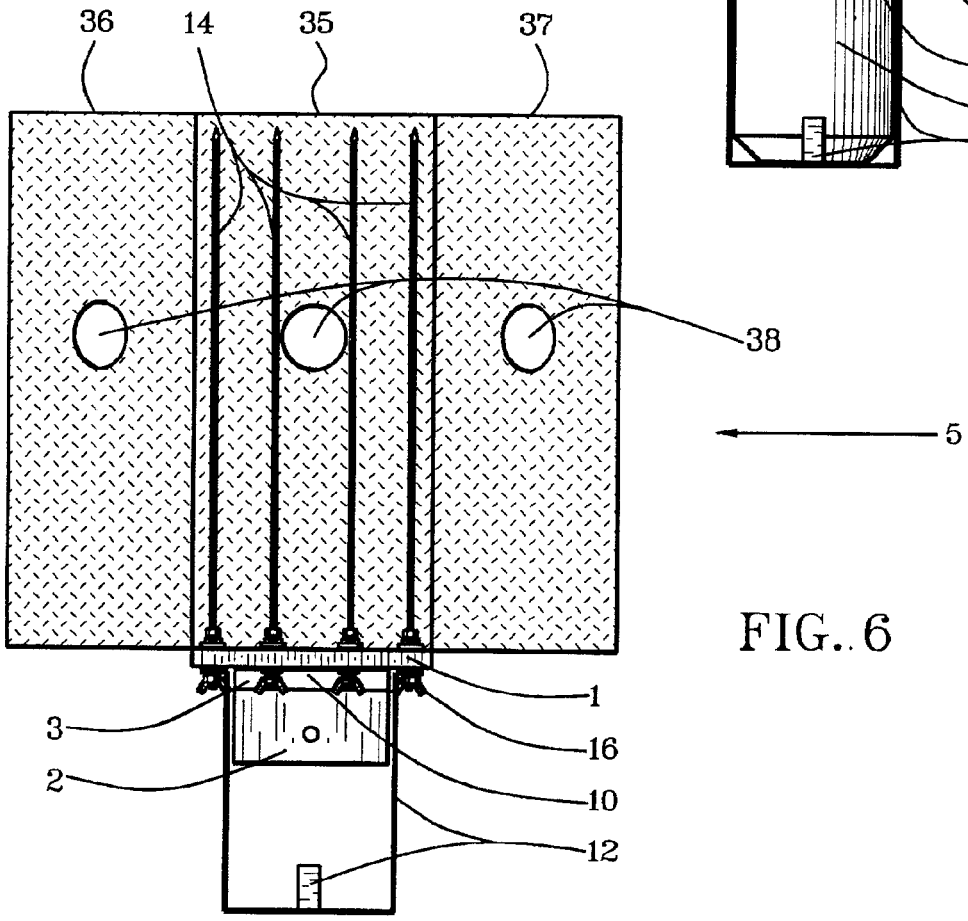
FIG. 6

REFLECTIVE FISHING LIGHT AND HEATER BRACKET

BACKGROUND OF THE INVENTION

This invention relates to fishing light-and heater brackets; particularly to a bracket that can be mounted to a boat, a dock, positioned on a surface or hung from lines to reflect light and heat in a desired direction from a gas light.

Light from lanterns and more recently, gas lights, are used commonly for effective nighttime fishing from boats, docks and water sides. Numerous holders, stands and attachments have been devised for this purpose. None are known, however, to have the convenience, diversity, reliability and efficiency of positioning a gas light and reflecting its light and heat desirably as taught by this invention.

Examples of most-closely related known but different devices are described in the following patent documents:

| U.S. Pat. No. | Inventor | Issue Date |
|---|---|---|
| 2,875,974 | Albert | Mar. 3, 1959 |
| 3,752,108 | Bovenzi | Aug. 14, 1973 |
| 3,843,082 | Garrett | Oct. 22, 1974 |
| 2,960,601 | Higgins | Nov. 15, 1960 |
| 3,008,679 | Powell | Nov. 14, 1961 |
| 3,745,329 | Runey, Jr. | Jul. 10, 1973 |
| 1,174,700 | Eastman | Mar. 7, 1916 |
| 3,847,286 | Garrett | Nov. 12, 1974 |

SUMMARY OF THE INVENTION

Objects of patentable novelty and utility taught by this invention are to provide a reflective fishing-light-and-heater bracket which:

- reflects light and optionally heat in a desired direction from a gas light or lantern;
- diverts light glare away from a person using the light for fishing;
- can be attached quickly and easily to nearly any boat gunwale, boat dock or pier;
- can be set up quickly and easily on any beach, lakeside, riverside, floor or other surface;
- can be hung with lines from a hanger; and
- is light, sturdy, inexpensive and easily portable or storable.

This invention accomplishes these objectives with a reflective fishing-light-and-heater bracket having a base plate that is designedly rectangular and made to rest on a gunwale of a boat for supporting a gas light and a reflector. The base plate includes a gunwale attachment on an attachment end, a light attachment on an attachment end and a reflector on top of the light end. The gunwale attachment is adaptable for attachment to all foreseeable gunwales, docks and piers. The base plate also can be mounted on horizontal or uneven surfaces or hung from lines suspended from a hanger. The light attachment includes a cannister basket and light holder. The reflector includes doors for selective back lighting. The base plate can be positioned to face the reflector in any direction.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 5 is a light-end view of the FIG. 1 illustration;

FIG. 6 is the light-end view of the FIG. 1 illustration with a gas cannister and a gas light removed;

DESCRIPTION OF PREFERRED EMBODIMENT

Figure 1:
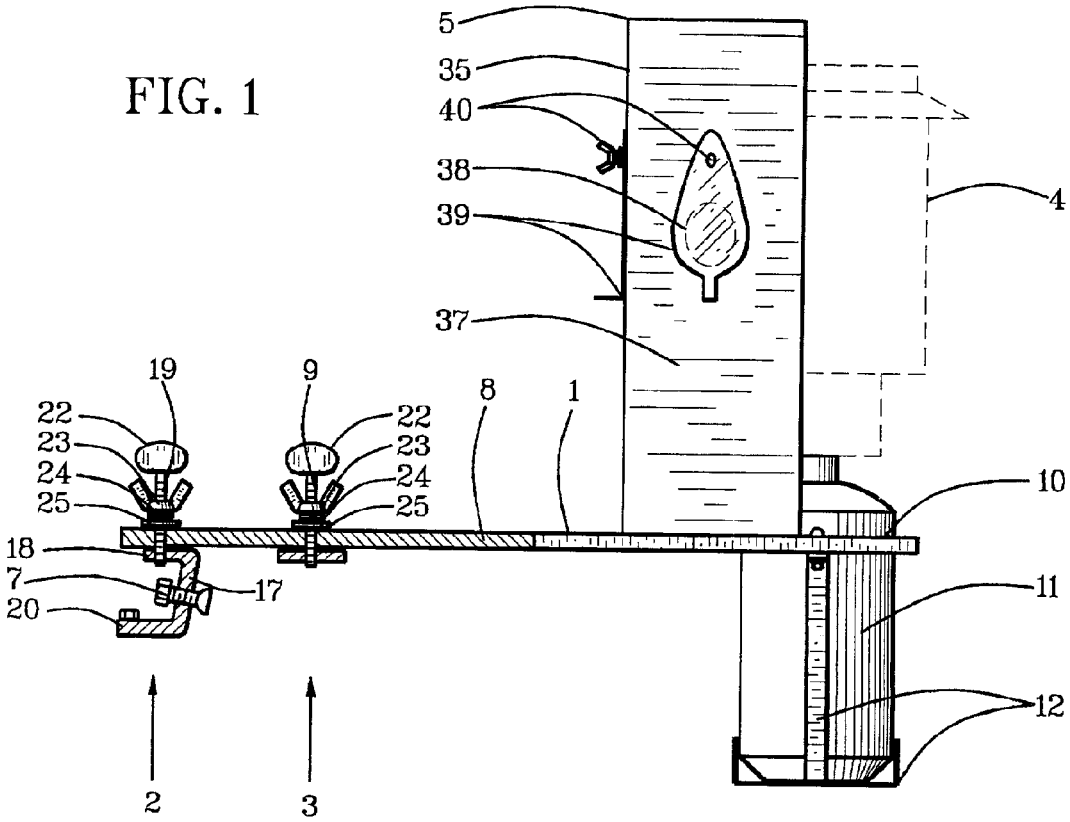
FIG. 1 is a partially cutaway elevation view of the reflective fishing-light-and-heater bracket having a pivotal adjustment jaw.

Listed numerically below with reference to the drawings are terms used to describe features of this invention. These terms and numbers assigned to them designate the same features throughout this description.

1. Base plate
2. Adjustment jaw
3. Base jaw
4. Gas light
5. Reflector
6. Reflective side
7. Jaw-adjustment rod
8. Adjustment slot
9. Clamp bolt
10. Cannister aperture
11. Gas cannister
12. Cannister basket
13. Leg-rod aperture
14. Leg rod
15. Surface
16. Leg wing nut
17. Pivotal adjustment jaw
18. Jaw top base
19. Pivot bolt
20. Jaw bottom base
21. Structure
22. Hand grip
23. Jam nut
24. Resilient lock washer
25. Flat washer
26. Wrench head
27. Wrench flats
28. Distal nut
29. Fastener wings
30. Integral adjustment jaw
31. Attached adjustment jaw
32. L-leg
33. Threaded fastener apertures
34. Attachment leg
35. Central wall
36. First side wall
37. Second side wall
38. Back-light aperture
39. Cover
40. Swivel member Referring to FIGS. 1–4, 10 and 14–15, the reflective fishing-light-and-heating bracket has a base plate 1 that is rectangular with a gunwale attachment that includes an adjustment jaw 2 and a base jaw 3 proximate an attachment end, a light attachment for attachment of a gas light 4 proximate a light end and a reflector 5 having a funneled wall extended vertically upward from a top of the base plate 1. The funneled wall of the reflector 5 has a reflective side 6 proximate the light attachment that is made to contain the gas light 4.

The base plate 1 is made preferably of an aluminum alloy or other material that is suitably light and yet strong, but generally soft for requiring flat-washer protection from most fastener components.

The adjustment jaw 2 includes an adjustment aperture that is extended horizontally through the adjustment jaw 2 for receiving a jaw-adjustment rod 7.

The base plate 1 includes an adjustment slot 8 that is extended predeterminedly intermediate the attachment end and the reflector 5.

The gunwale attachment includes the base jaw 3 that has a clamp aperture for being attachable to the base plate 1 with a clamp bolt 9 that is positioned selectively in the adjustment slot 8.

The light attachment includes a cannister aperture 10 in the base plate 1 for receiving a gas cannister 11 vertically below the gas light 4. The light attachment includes a cannister basket 12 below the base plate 1 for supporting the gas cannister 11 below the base plate 1 and for supporting the gas light 4 vertically above the base plate 1.

Referring to FIGS. 2, 4–8, 14–15 and 17, the base plate 1 includes a plurality of at least two leg-rod apertures 13 for receiving leg-attachment ends of leg rods 14 vertically for extending the leg rods 14 downwardly from the base plate 1 for supporting the base plate 1 on surfaces 15 that include water-side ground, decks, floors, and piers optionally to attachment of the reflective fishing-light-and-heater bracket to a gunwale, a dock or a pier. Also, the leg-rod apertures 13, at preferably four corners, can be employed for attachment of lines from a hanger for hanging the reflective fishing-light-and-heating bracket from wherever desired. The leg-attachment ends of the leg rods 14 can be threaded for being threaded into the leg-rod apertures 13 that are threaded correspondingly. Optionally, the leg-attachment ends of the leg rods 14 can be threaded to receive fastener nuts that can include leg wing nuts 16 in fastener combination with flat washers, lock washers and jam nuts.

Figure 8:
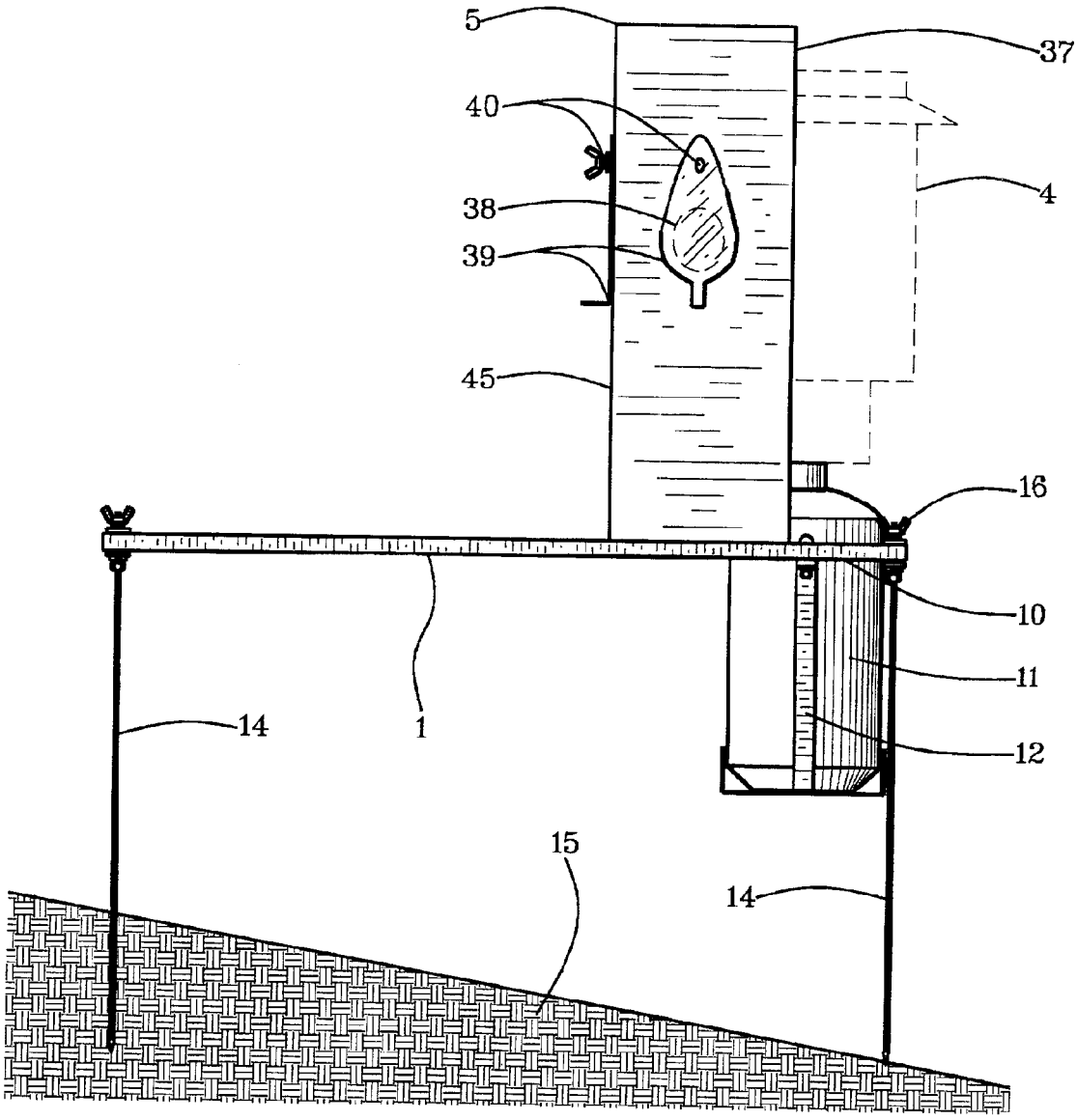
FIG. 8 is a side elevation view of the reflective fishing-light-and-heater bracket having leg rods positioned for table-like support on a sloping ground surface.
Figure 9:
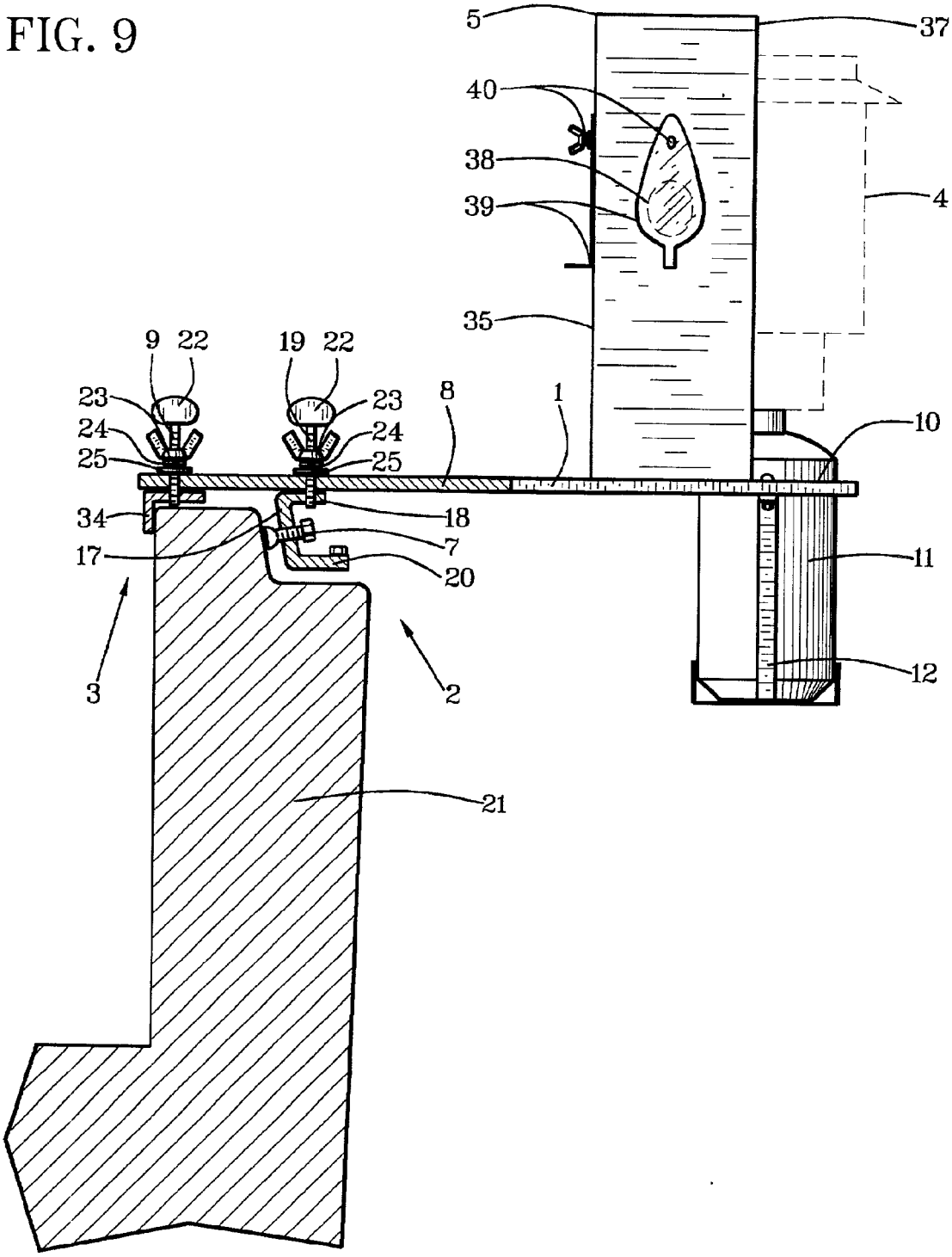
FIG. 9 is a side view of the FIG. 1 embodiment shown mounted to a gunwale with the reflector facing outwardly.
Figure 10:
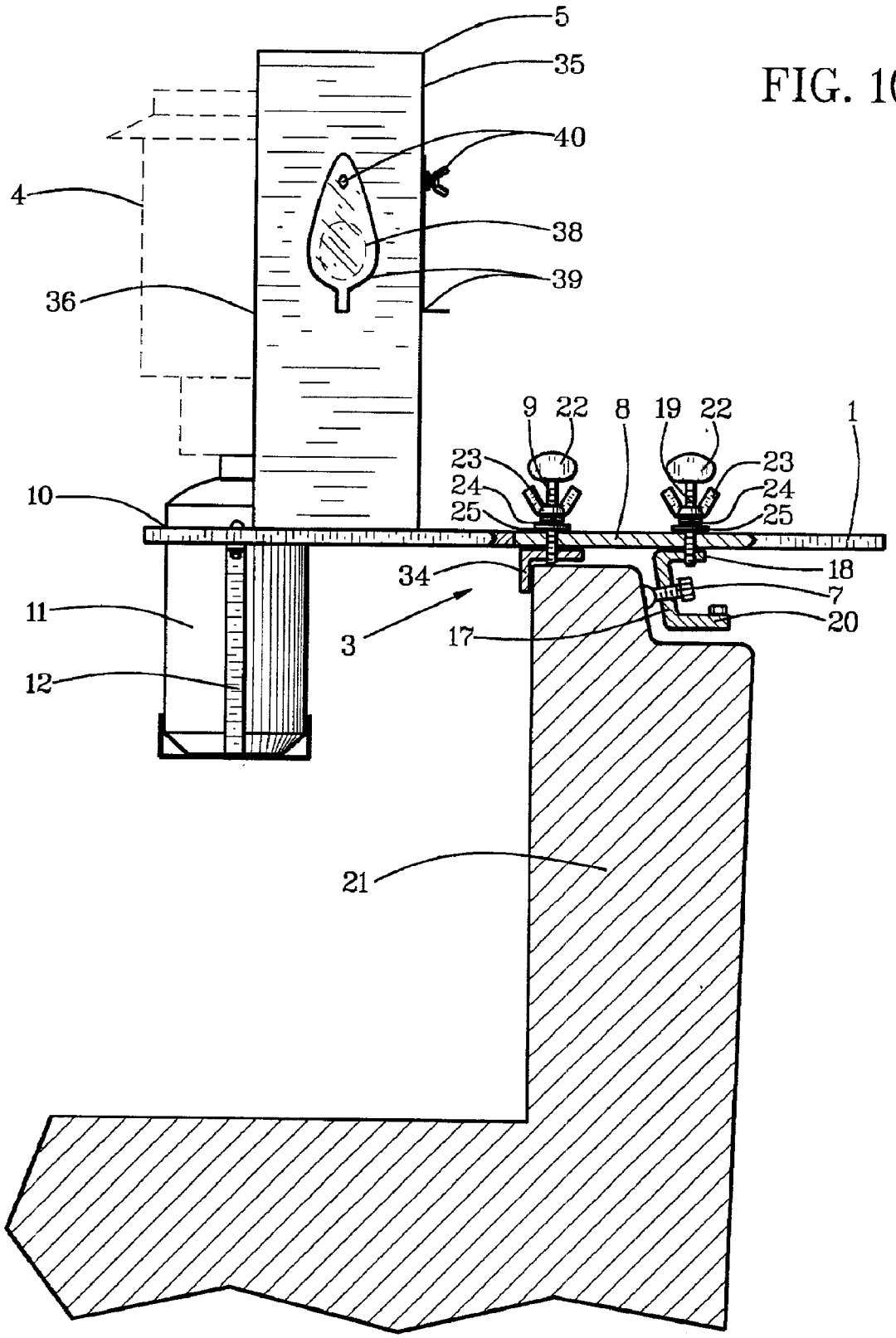
FIG. 10 is a side view of the FIG. 1 embodiment shown mounted to a gunwale with the reflector facing inwardly.

The leg-rod apertures 13 can be positioned at sides of ends of the base plate 1 for a table-like support. As illustrated in FIG. 8, this also allows leveling of the base plate 1 on uneven or sloping ground by pushing the leg rods 14 further into pliable surfaces at high areas.

Optional to table-like positioning, the leg-rod apertures 13 can be positioned at oppositely disposed sides of one or both ends of the base plate 1, or on either or both sides of the reflector 5. The leg-rod apertures 13 can also be leg-storage apertures for containing the leg rods 14 uprightly above the base plate, preferably proximate the reflector 5 where they out of the way, when not in use to support the base plate 1.

Referring to FIGS. 1–4 and 9–10, the gunwale attachment can include a pivotal adjustment jaw 17 for selectively pivotal and linear positioning of the gunwale attachment to the base plate 1. The pivotal adjustment jaw 17 can be extended at a predetermined angle downwardly from a jaw top base 18. The jaw top base 18 includes a jaw-attachment aperture having internal threads for receiving a pivot bolt 19 which has external threads for attaching the jaw top base 18 to the base plate 1. The pivotal adjustment jaw 17 can have a jaw bottom base 20 that is parallel to the jaw top base 18.

Figure 14:
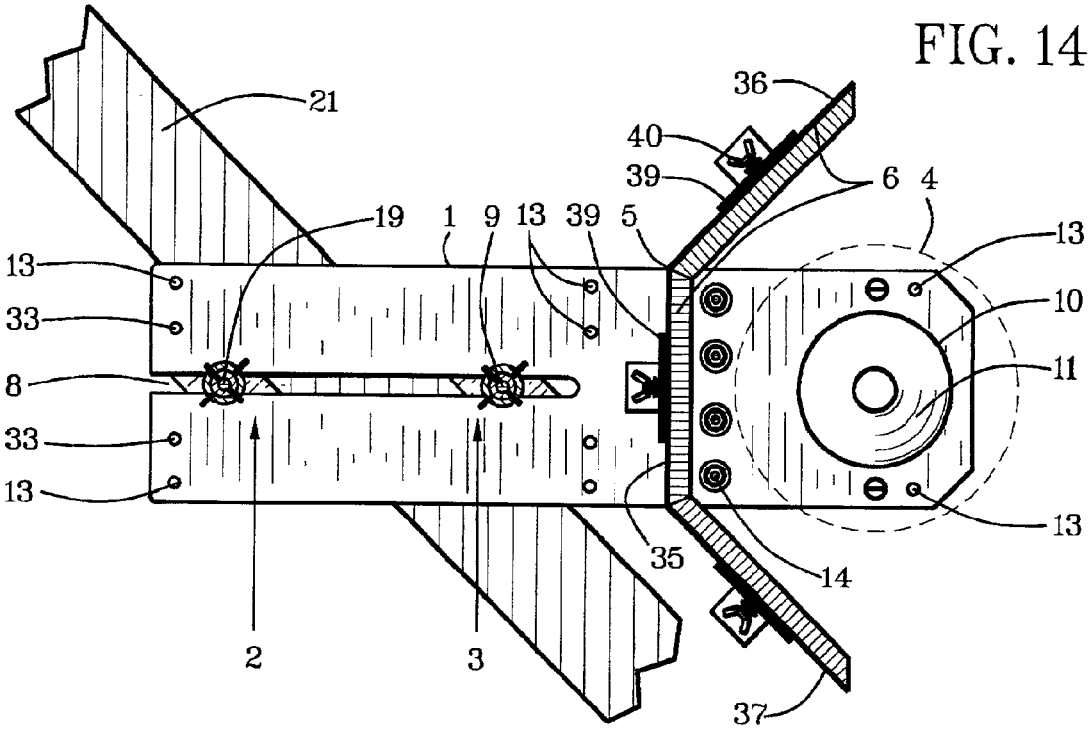
FIG. 14 is a partially cutaway top view of the FIG. 1 embodiment showing a linear structure representative of a gunwale or dock with angled attachment to the base plate.
Figure 15:
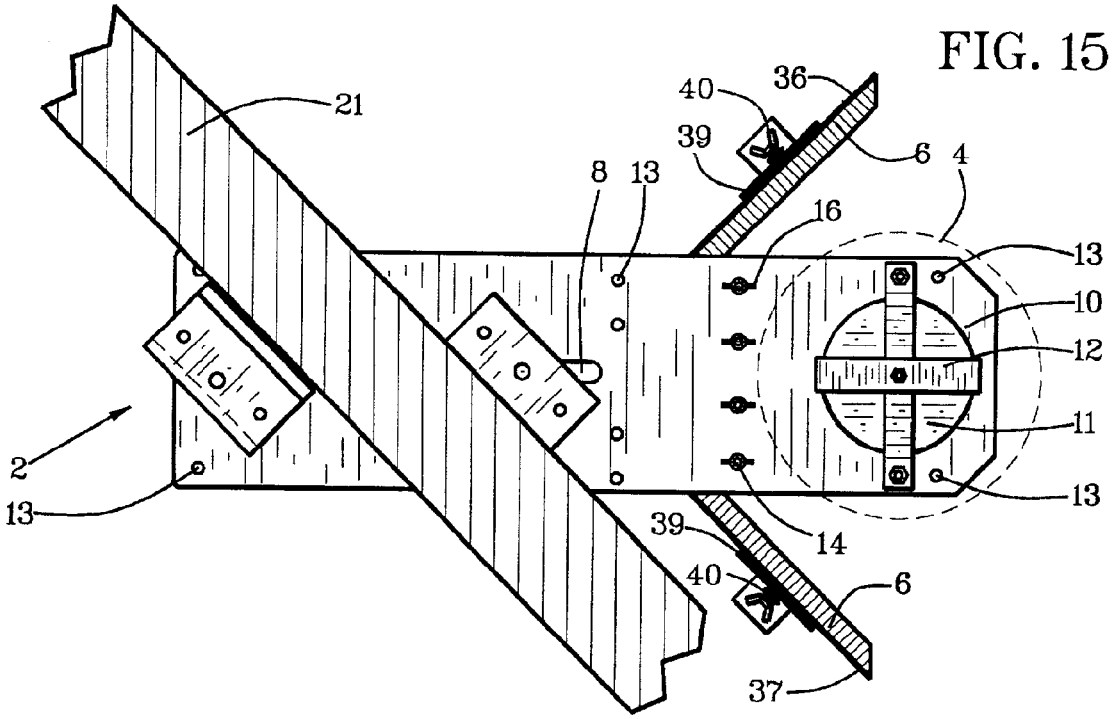
FIG. 15 is a partially cutaway bottom view of the FIG. 1 embodiment showing the linear structure with angled attachment of the base plate.

The gunwale attachment includes the base jaw 3 having at least one clamp aperture for being attached to the base plate 1 with the clamp bolt 9 in the adjustment slot 8 for selectively pivotal and linear positioning of the gunwale attachment to the base plate 1. As depicted in FIGS. 14–15, selectively pivotal and linear positioning of the gunwale attachment to the base plate 1 can be employed for positioning the base plate 1 at select pivotal and linear positions in relationship to a structure 21 that is intended to include a gunwale of a marine vehicle, a dock, a pier or other water-side structure.

Referring to FIGS. 1, 3, 9–10, 14 and 18, the pivot bolt 19 preferably includes a hand grip 22 that is depicted as a wafer head for non-interference finger-grasping proximate a grip end of external threads thereon. Positioned on the pivot bolt 19 sequentially from the hand grip 22 are a jam nut 23, a resilient lock washer 24, a flat washer 25, the base plate 1 and the jaw top base 18.

The bottom of the base plate 1 abuts the jaw top base 18, the flat washer 25 abuts the top of the base plate 1 and the jam nut 23 abuts the resilient lock washer 24 with frictional screw-fastener pressure of the jam nut 23 against the resilient lock washer 24 for snugly affixing the pivotal adjustment jaw 17 at a desired position linearly in the adjustment slot 8 and at a desired angle from the adjustment slot 8 for positioning the base plate 1 angularly and linearly on the structure 21 to which the base plate 1 is attached selectively with the gunwale attachment.

Figure 19:
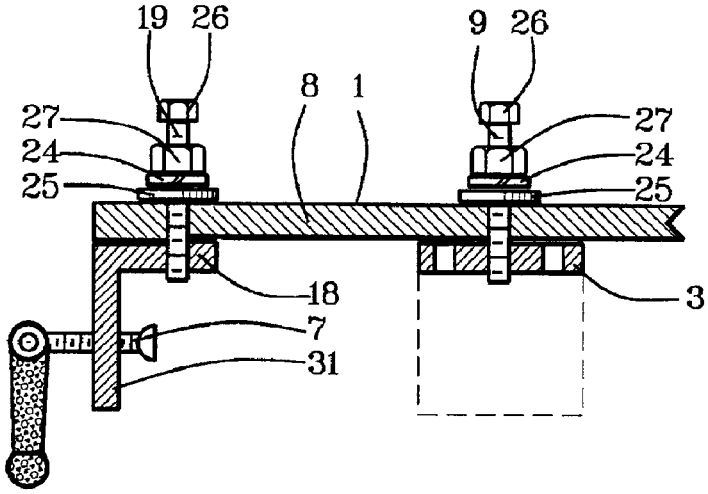
FIG. 19 is a fragmentary and partially cutaway side view of the attachment end showing wrench-head-fastener attachment of the adjustment jaw and the base jaw to the base plate at the adjustment slot.

As shown in FIG. 19, the pivot bolt 19 for a selected adjustment jaw 2, that includes the attached adjustment jaw 31, can include a wrench head 26 proximate the grip end of the external threads thereon. The jam nut 23 can include wrench flats 27.

Figure 20:
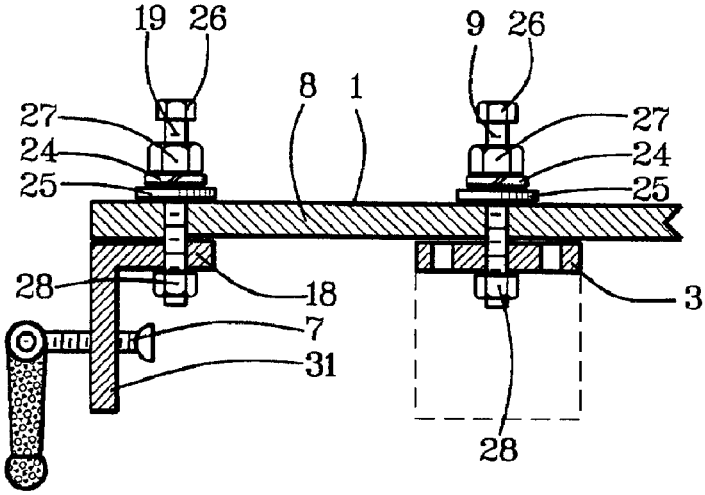
FIG. 20 is a fragmentary and partially cutaway side view of the attachment end showing use of a distal nut for wrench-head-fastener attachment of the adjustment jaw and the base jaw to the base plate at the adjustment slot.

Use of fastener nuts with wrench flats requires use of a wrench which can easily be lost in marine conditions, particularly at night when lights are used. For this reason, hand-grip fasteners are preferred. Wrench fasteners, however, can be tightened more securely and may be preferred by some users for some use conditions. Aids to use of wrenches can include use of special box wrenches that can be secured on a line or chain. Securing the bolts in the jaw top base 18 or other base also can help. Use of the adjustment slot 8 allows permanent or variously affixed attachment of the pivot bolt 19 or other bolt to the jaw top base 18, to the base jaw 3 or other base member with a distal nut 28 as depicted in FIG. 20 or with a thread adherent.

Figure 11:
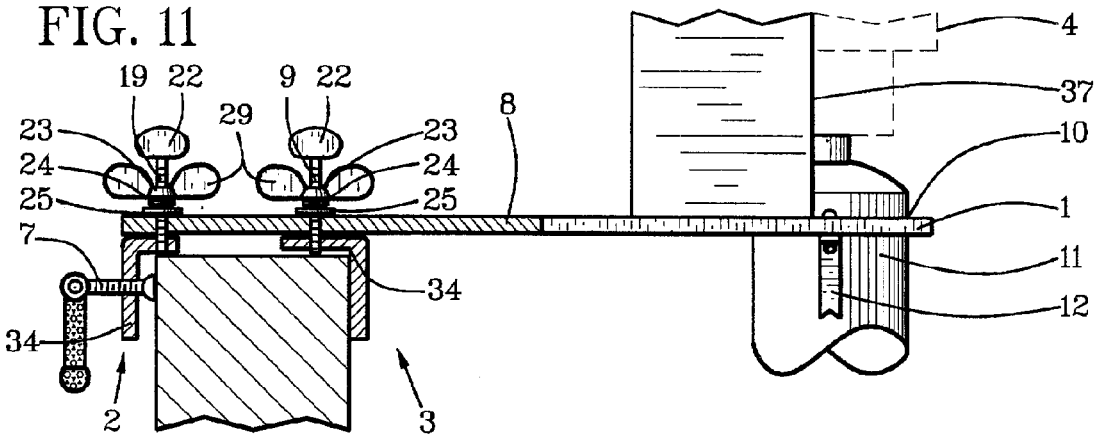
FIG. 11 is a fragmentary and partially cutaway side view showing wing-nut fastener attachment of an adjustment jaw and a base jaw to an adjustment slot of a base plate.
Figure 12:
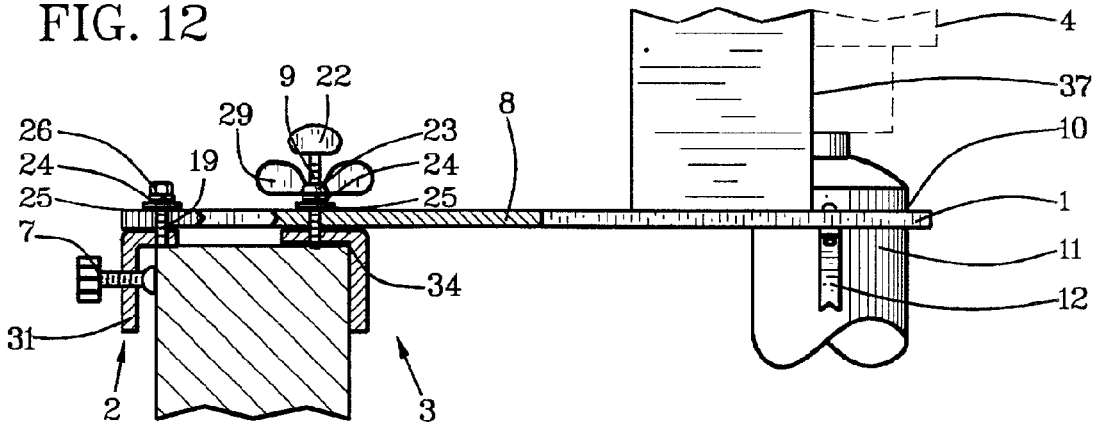
FIG. 12 is a fragmentary and partially cutaway side view showing wrench-nut fastener attachment of an adjustment jaw to bolt holes of the a base jaw and wing-nut fastener attachment of the base jaw to the base plate at the adjustment slot.
Figure 13:
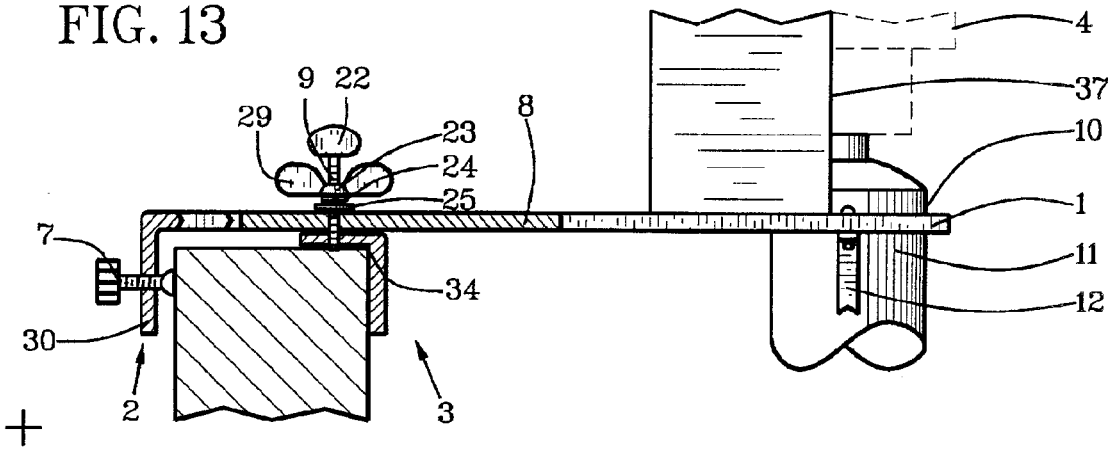
FIG. 13 is a fragmentary and partially cutaway side view showing an integral extension of the adjustment jaw having a jaw-adjustment rod and showing wing-nut fastener attachment of the base jaw to the base plate at the adjustment slot.

As shown in FIGS. 11–13, the jam nut 23 on the pivot bolt 19 and on the clamp bolt 9 can have particularly large predetermined fastener wings 29 for finger-gasping leverage.

As shown in FIGS. 1–3, 9–13, 16 and 18, the clamp bolt 9, as well as the pivot bolt 19, can include the hand grip 22 in combination with a jam nut 23 that can have either straight-wing finger grips or the large fastener wings 29.

Figure 16:
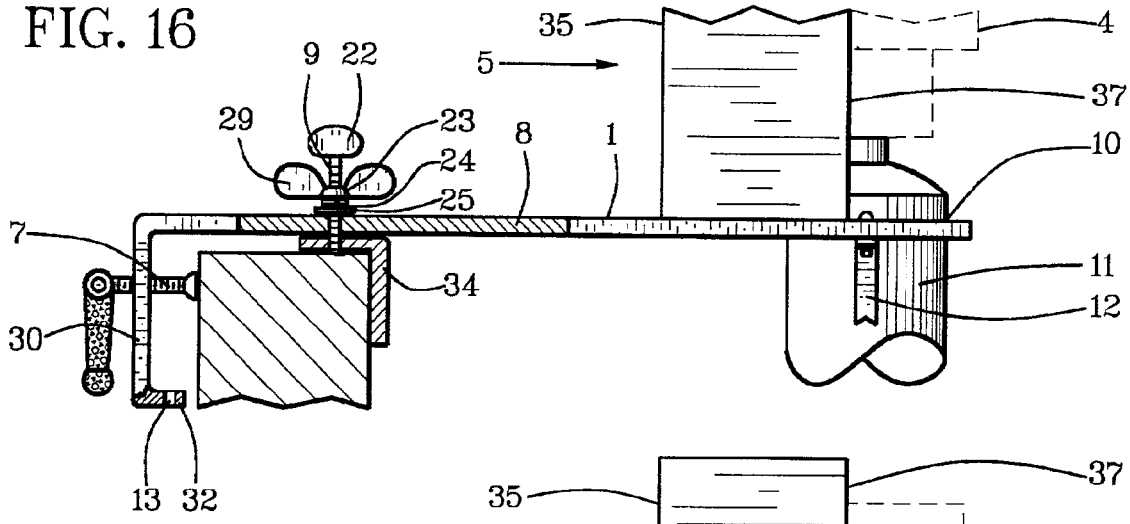
FIG. 16 is a fragmentary and partially cutaway side view showing the integral extension of the adjustment jaw having a bottom base and showing wing-nut fastener attachment of the base jaw to the base plate at the adjustment slot.
Figure 17:
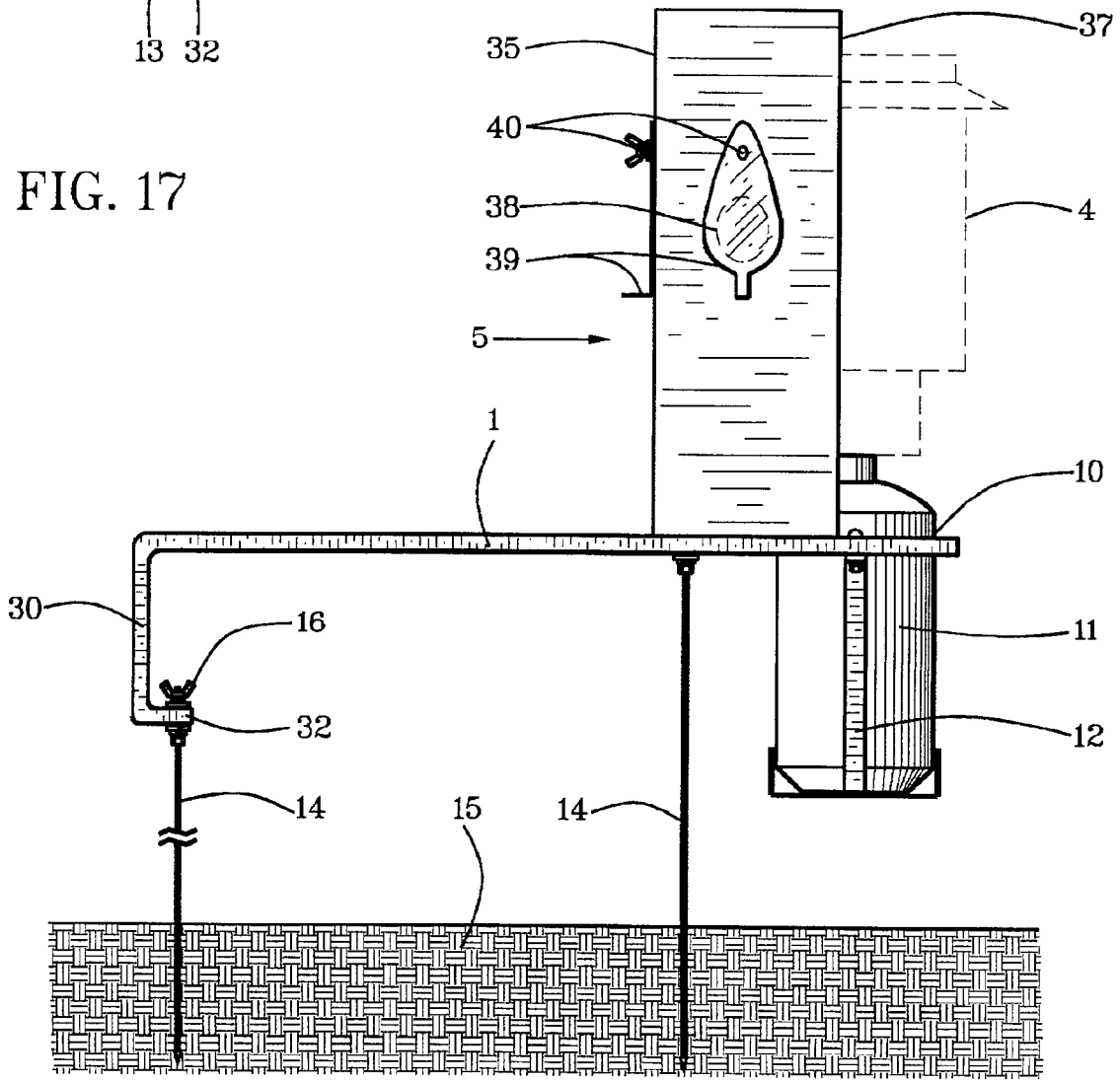
FIG. 17 is a partially cutaway side view showing the integral extension of the adjustment jaw having a bottom base with a leg rod attached and extended into a ground surface for support from the attachment end or optionally from proximate the reflector.
Figure 18:
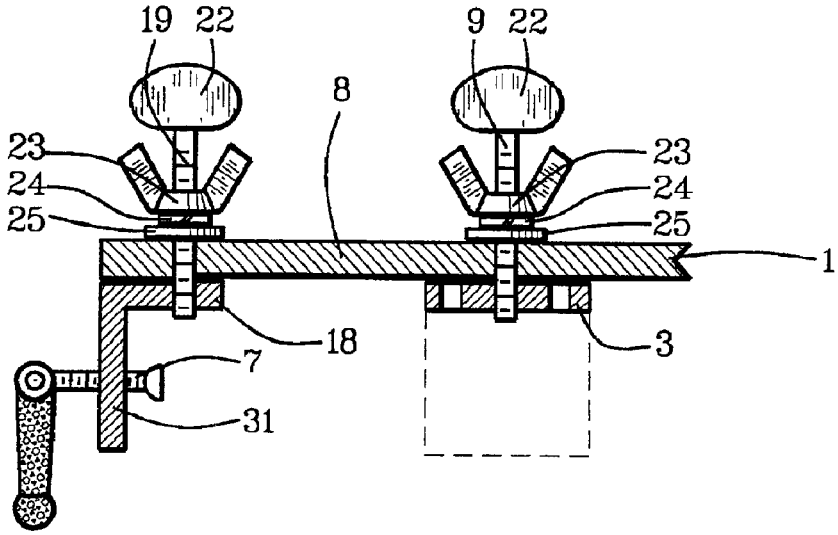
FIG. 18 is a fragmentary and partially cutaway side view of the attachment end showing wing-nut-fastener attachment of an adjustment jaw and a base jaw to the base plate at the adjustment slot.

The adjustment jaw 2 can include a stationary adjustment jaw that is an integral adjustment jaw 30 which is extended integrally from the attachment end of the base plate 1, as shown in FIGS. 13 and 16–17. Optionally, the stationary adjustment bar can be an attached adjustment jaw 31 that is attached removably as shown in FIGS. 11–12 and 18–20. The adjustment jaw 2, particularly the integral adjustment jaw 30 can have an L-leg 32 with at least two leg-rod apertures 13 as shown in FIGS. 16–17.

The integral adjustment jaw 30 is preferred for having leg rods 14 extended from it as shown in FIG. 17 to support the entire weight of the bracket when the leg rod 14 is inserted a sufficient depth into ground or other pliable surface 15. For most ground-support uses, however, the entire weight is best supported with the leg rod 14 suspended from a leg-rod aperture 13 proximate the reflector 5.

Figure 2:
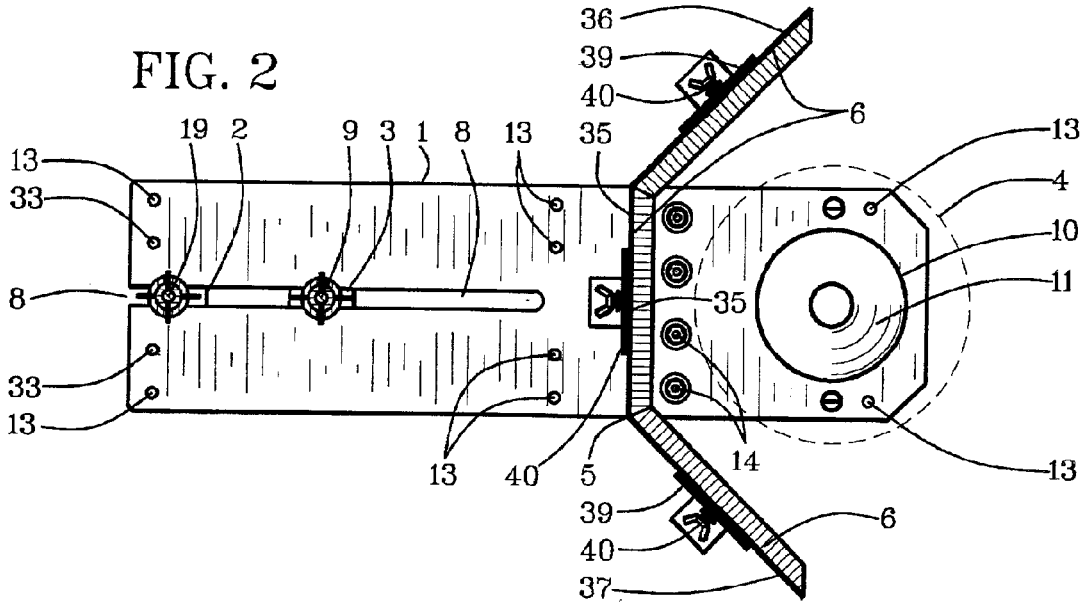
FIG. 2 is a partially cutaway top view of the FIG. 1 illustration.
Figure 3:
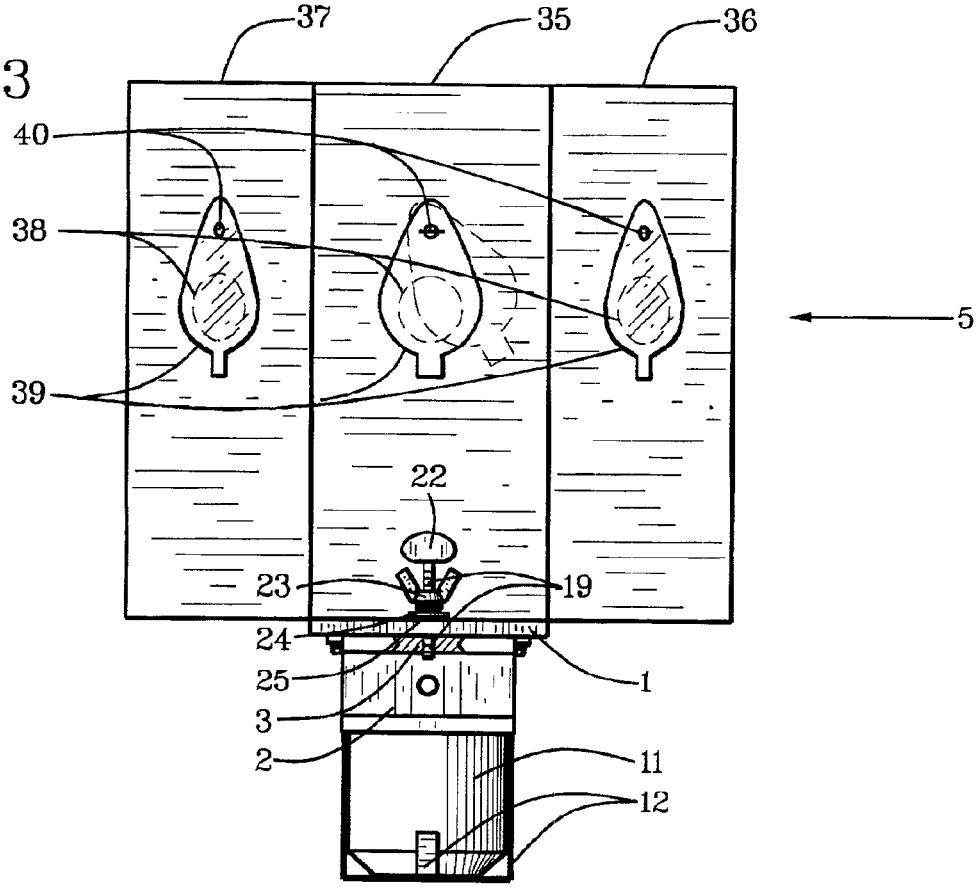
FIG. 3 is a partially cutaway attachment-end view of the FIG. 1 illustration.
Figure 4:
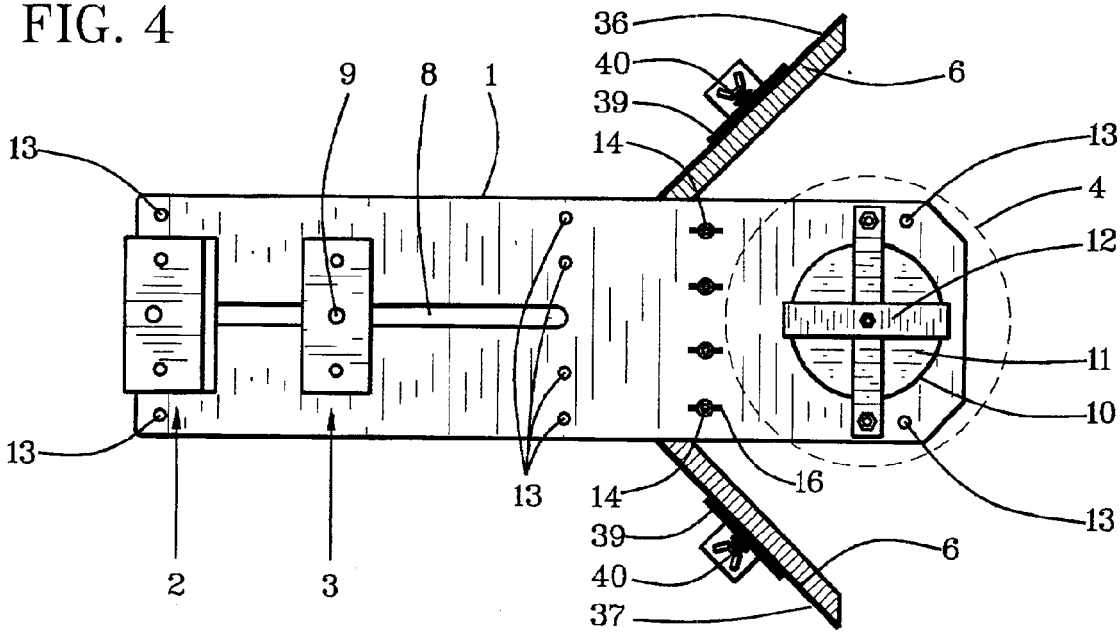
FIG. 4 is a partially cutaway bottom view of the FIG. 1 illustration.
Figure 7:
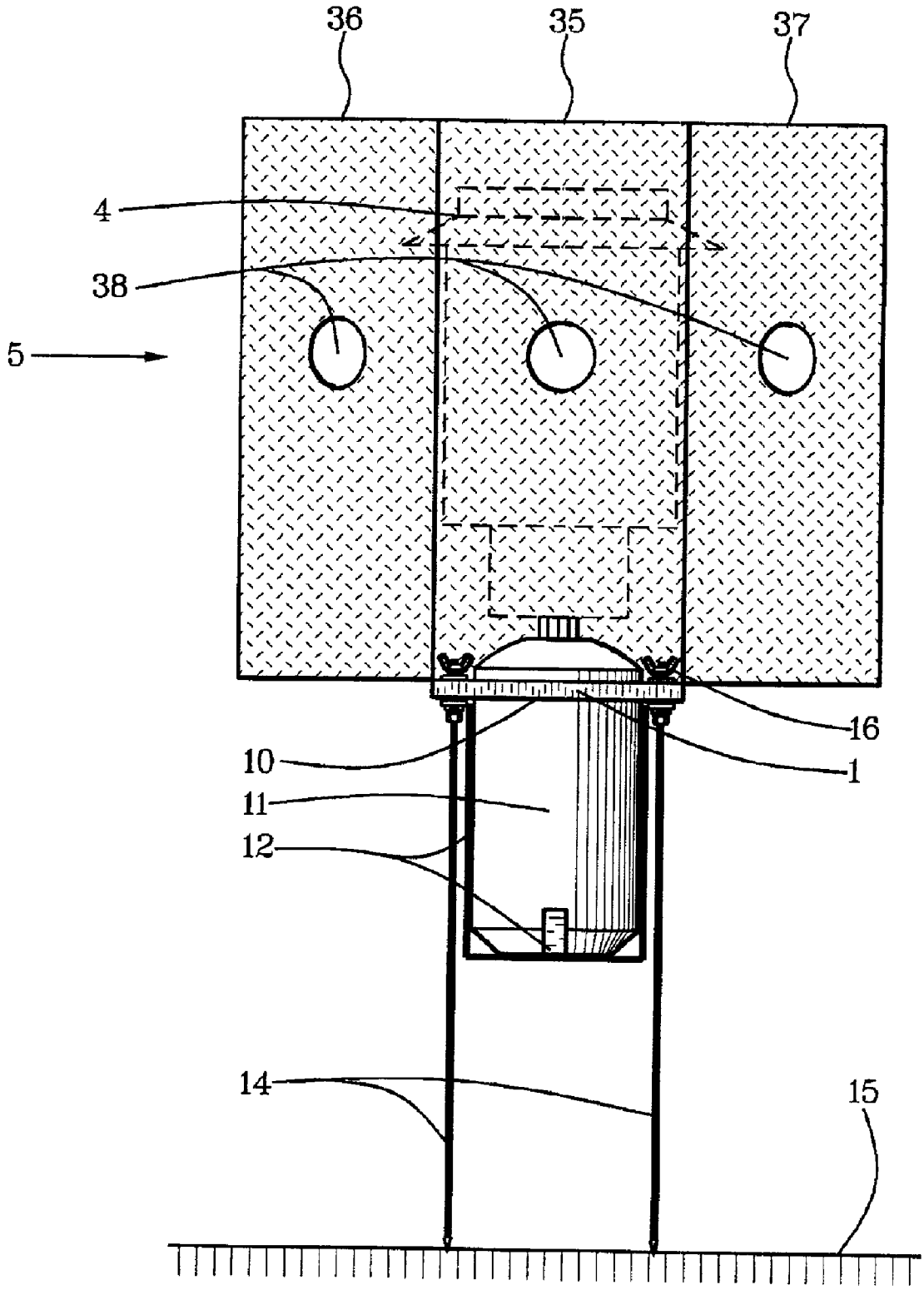
FIG. 7 is a light-end view of the reflective fishing-light-and-heater bracket having leg rods positioned for table-like support on a desired surface.

As shown in FIGS. 2 and 14, the attachment end of the base plate 1 can include a plurality of threaded fastener apertures 33 and the leg-rod apertures 13. This allows attachment of the attached adjustment jaw 31 and the leg rods 14 to the base plate 1.

The base jaw 3 can include an attachment leg 34 for buttressing resistance in opposition to attachment pressure from the jaw-adjustment rod 7 of the adjustment jaw 2 as shown in FIGS. 9–13 and 16.

As shown in FIGS. 2, 4 and 14–15, there can be at least one light-attachment aperture that can be a leg-rod aperture 13 proximate the reflector 5 in the base plate 1. Some but not all gas lights 4 can be supported by attachment to the gas cannister 11. Provision for a separate light-attachment aperture, which can be, but need not be, the leg-rod apertures 13, is preferable.

As shown in FIGS. 1–17, the reflector 5 preferably includes a plurality of reflective walls, although a single curved wall can be employed. The plurality of reflective walls includes a central wall 35, a first side wall 36 and a second side wall 37. The central wall 35 is orthogonal to first and second sides of the base plate 1. The first side wall 36 is extended at a predetermined angle laterally from the first side of the base plate 1 in a direction of the light end. The second side wall 37 is extended at a predetermined angle laterally from the second side of the base plate 1 in the direction of the light end.

The funneled wall of the reflector 5 includes at least one back-light aperture 38 having a cover 39 that is opened selectively for allowing passage of a desired amount of light from the gas light 4 through the reflector 5. The back-light aperture 38 includes the cover 39 in each of the plurality of the reflective walls for a plurality of the back-light apertures 38 with the covers 39 in the reflective walls of the reflector 5.

Preferably, the cover 39 is suspended from a swivel member 40 that is vertically above the back-light aperture 38 for hanging over the back-light aperture 38 and the swivel member 40 includes predetermined resistance to swiveling of the cover 39 for positioning the cover 39 over the back-light aperture 38 selectively.

A new and useful reflective fishing-light-and-heater bracket having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A reflecting fishing-light-and-bracket heater bracket comprising:

a base plate that is rectangular with a gunwale attachment proximate an attachment end, a light attachment for attachment of a gas light proximate a light end that is oppositely disposed from the attachment end and a reflector having a funneled wall extended vertically upward from a top of the base plate;

the funneled wall of the reflector having a reflective side proximate the light attachment;

the gunwale attachment including an adjustment jaw that is extended downward from the base plate predeterminedly proximate the attachment end;

the adjustment jaw including an adjustment aperture that is extended horizontally through the adjustment jaw for receiving a jaw adjustment rod;

the base plate including an adjustment rod that is extended predeterminedly intermediate the attachment end and the reflector;

the gunwale attachment including a base jaw having a clamp aperture for being attachable to the base plate with a clamp bolt that is positioned selectively in the adjustment slot;

the light attachment includes a canister aperture in the base plate for receiving a gas canister vertically below a gas light; and the light attachment including a canister basket vertically below the canister aperture for supporting the gas canister below the base plate and for supporting the gas light vertically above the base plate.

2. The reflective fishing-light-and heater bracket of claim 1 and further comprising:

a plurality of leg apertures in the base plate for receiving leg-attachment ends of leg rods vertically for extending the leg rods downwardly from the bass plate for supporting the base plate on surfaces predeterminedly;

a plurality of rod-storage apertures in the base plate proximate the reflector for receiving the leg-attachment ends of the leg rods and for storing the leg rods vertically upward from the base plate in a non-use mode; and a plurality of the leg rods that are storable vertically upwards in the rod storage apertures for a non-use mode and that are attachable vertically downward in the leg-rod apertures for a use mode.

3. The reflective fishing-light-and-heater bracket of claim 2, wherein the leg-rod apertures are positioned predeterminedly at oppositely disposed sides of the base plate.

4. The reflective fishing-light-and heater bracket of claim 2, wherein the leg-rod apertures include the leg-storage apertures.

5. The reflective fishing-light-and-heating bracket of claim 1, wherein the gunwale attachment includes a pivotal adjustment jaw for pivotal and linear positioning of the gunwale attachment on the base plate;

the pivotal adjustment jaw is extended predeterminedly downward from a jaw top base of the pivotal adjustment jaw;

the jaw top base includes a jaw-attachment aperture having internal threads for receiving a pivot bolt which has external threads for attaching the jaw top base to the base plate;

a jaw bottom base on the pivotal adjustment base;

the jaw bottom base is parallel to the jaw top base;

the adjustment aperture is extended horizontally through the pivotal adjustment jaw for receiving a jaw-adjustment rod;

the jaw top base is attachable to the base plate with the pivot bolt in the adjustment slot; and the gunwale attachment including the base jaw having at least one clamp aperture for being attached to the base plate with a clamp bolt in the adjustment slot for pivotal and linear positioning on the gunwale attachment on the base plate.

6. The reflective fishing-light-and-heater of claim 5, wherein the pivot bolt includes a hand grip proximate a grip end of the external threads thereon;

positioned sequentially from the hand grip on the pivot bolt are a jam nut, a resilient lock washer, a flat washer, the base plate and the jaw top base; and the base plate abuts the base plate and the jam nut abuts the resilient lock washer with screw-fastener pressure of the jam nut against the resilient lock washer for snugly affixing the pivotal jaw at a desired position linearly in the adjustment slot and at a desired angle from the adjustment slot for positioning the base plate angularly and linearly on a structure to which the base plate is attached selectively with the gunwale attachment.

7. The reflective fishing-light-and-heater bracket of claim 1, wherein the gunwale attachment includes a pivotal adjustment jaw for pivotal and linear positioning of the gunwale attachment on the base plate;

the pivotal adjustment jaw is extended predetermindly downward from a jaw top base of the pivotal adjustment jaw;

the top base includes the jaw attachment aperture having the internal threads for receiving a pivot bolt which has the external threads for attaching the jaw top base to the base plate;

a pivot bolt includes a wrench head proximate the grip end of the external threads thereon;

a jam nut includes wrench flats;

positioned sequentially from the head on the pivot bolt are the jam nut, a resilient lock washer, a flat washer, the base plate and a jaw top base; and the base plate abuts the jaw top base, the flat washer abuts the base plate and a jam nut abuts a resilient lock washer for snugly affixing the pivotal adjustment jaw at a desired position linearly in an adjustment slot for positioning the base plate angularly and linearly on a structure to which the base plate is attached selectively with the gunwale attachment.

8. The reflective fishing-light-and-heater bracket of claim 7, wherein the clamp bolt is affixed to the jaw top base for ease of handling small components in a marine environment.

9. The reflective fishing-light-and-heater bracket of claim 6, wherein the clamp bolt includes the hand grip proximate a grip end of the external threads thereon;

positioned sequentially from the hand grip on the clamp bolt are the jam nut, the resilient lock washer, the flat washer, the base plate and the base jaw;

the base plates abuts the base jaw, the flat washer abuts the base plate and the jam nut abuts the resilient lock washer with screw-pressure of the jam nut against the resilient lock washer for snugly affixing the base jaw at a desired position linearly in the adjustment slot for positioning the base plate anguarly and linearly on the structure to which the base plate is attached.

10. The reflective fishing-light-and-heater bracket of claim 5, wherein the clamp bolt includes the hand grip proximate the grip end of the external threads thereon;

positioned sequentially from the hand grip on the clamp bolt are the jam nut, the resilient lock washer, the flat washer, the flat washer and the base jaw; and the base plate abuts the base jaw, the flat washer abuts the base plate and the jam nut abuts the resilient lock washer for snugly affixing the base jaw at a desired position linearly in the adjustment slot and at a desired angle from the adjustment slot for positioning the base plate angularly and linearly on a structure to which the base plate is attached selectively with the gunwale attachment.

11. The reflective fishing-light-and-heater bracket of claim 5, wherein the pivot bolt has a predetermined wafer head for finger-grasping leverage; and the jam nut has predetermined fastener wings for finger-grasping leverage.

12. The reflective fishing-light-and-heater bracket of claim 7, Wherein the clamp bolt has the predetermined water head for finger-grasping leverage; and the jam nut has predetermined fastener wings for finger-grasping leverage.

13. The reflective fishing-light-and-heater bracket of claim 1, wherein the gunwale attachment includes the pivotal base jaw for pivotal and linear positioning of the gunwale attachment on the base plate;

the base jaw includes the jaw-attachment aperture having the internal threads for receiving the clamp bolt which has external threads for attaching the base jaw to the base plate;

the clamp bolt includes the wrench head proximate the grip end of the external threads thereon;

the jam nut includes wrench flats;

positioned sequentially from the wrench head on the clamp bolt are the jam nut, the resilient lock washer, the base plate and the base jaw; and the base plate abuts the base jaw, the flat washer abuts the base plate and the jam nut abuts the resilient lock washer with screw-fastener pressure of the jam nut against the resilient lock washer for snugly affixing the pivotal base jaw at a desired position linearly along the adjustment slot and at a desired angle from the adjustment slot for positioning the base plate angularly and linearly on a structure to which the base plate is attached selectively with the gunwale attachment.

14. The reflective fishing-light-and-heater bracket of claim 13, wherein the clamp bolt is affixed to the base jaw for ease of handling small components in a marine environment.

15. The reflective fishing-light-and-heater bracket of claim 1, wherein the adjustment jaw includes a stationary adjustment jaw that is attached rigidly to the attachment end of the base plate.

16. The reflective fishing-light-and-heater bracket of claim 15, wherein the stationary adjustment jaw is attached removably to the attachment end of the base plate with fastener bolts.

17. The reflective fishing-light-and-heater bracket of claim 15, wherein the stationary adjustment jaw is unremovably integral with the attachment end of the base plate.

18. The reflective fishing-light-and-heater bracket of claim 15, wherein the adjustment jaw includes an L-shaped leg that is parallel to the base plate and extended predeterminedly in the direction of the light end.

19. The reflective fishing-light-and-heater bracket of claim 18, wherein the L-shaped leg includes at least two of the leg-rod apertures proximate oppositely disposed sides thereof.

20. The reflective fishing-light-and-heater bracket of claim 1, wherein the attachment end of the base plate includes a plurality of threaded fastener apertures that are vertical for attachment of the adjustment jaw, and the attachment end of the base plate includes at least two of the leg-rod apertures proximate oppositely disposed sides thereof.

21. The reflective fishing-light-and-heater bracket of claim 1, wherein the base jaw includes an attachment plate having fastener apertures for fastening the base jaw to appendages and to structural components selectively.

22. The reflective fishing-light-and-heater bracket of claim 1, wherein the base jaw includes an attachment leg for buttressing resistance in opposition to attachment pressure from the jaw-adjustment rod.

23. The reflective fishing-light-and heater bracket of claim 1 and further comprising:

at least one light-attachment aperture in the base plate.

24. The reflective fishing-light-and-heater bracket of claim 1, wherein the reflector includes a plurality of reflective walls.

25. The reflective fishing-light-and-heater bracket of claim 24, wherein the plurality of reflective walls includes a central wall, a first side wall and a second side wall;

the central wall is orthogonal to first and second sides of the base plate the first side wall is extended at a predetermined angle laterally from the first side wall in the direction of the light end; and the second side wall is extended at a predetermined angle laterally from the second side of the base plate in the direction of the light end.

26. The reflective fishing-light-and-heater bracket of claim 1, wherein the funneled wall includes at least one back-light aperture having a cover that is opened selectively for allowing passage of a desired amount of light from the gas light through the reflector.

27. The reflective fishing-light-and-heater bracket of claim 26, wherein [the back-light aperture includes the cover in each of the plurality of the reflective walls for the plurality of the back-light apertures with the covers in the reflective walls] the funneled walls include a plurality of reflective walls each having the back-light aperture therein and each aperture having a cover thereon.

28. The reflective fishing-light-and-heater bracket of claim 26, wherein the cover is suspended from a swivel member that is vertically above the back-light aperture for hanging over the back-light aperture; and the swivel member includes a predetermined resistance to swiveling of the cover for positioning the cover over the back-light aperture, selectively.

* * * * *